US012575661B1

(12) United States Patent
Kraft

(10) Patent No.: US 12,575,661 B1
(45) Date of Patent: Mar. 17, 2026

(54) PHONE AND ACCESSORY HOLDER

(71) Applicant: James Kraft, Boca Raton, FL (US)

(72) Inventor: James Kraft, Boca Raton, FL (US)

( * ) Notice: Subject to any disclaimer, the term of this patent is extended or adjusted under 35 U.S.C. 154(b) by 167 days.

(21) Appl. No.: 18/223,748

(22) Filed: Jul. 19, 2023

Related U.S. Application Data

(60) Provisional application No. 63/413,321, filed on Oct. 5, 2022.

(51) Int. Cl.
*A45F 5/02* (2006.01)
*A45F 5/00* (2006.01)

(52) U.S. Cl.
CPC ..... *A45F 5/021* (2013.01); *A45F 5/1516* (2025.01)

(58) Field of Classification Search
CPC ..... A45F 5/021; A45F 5/1516; A45F 5/1508; Y10S 224/93
USPC ..... 224/671, 674, 930
See application file for complete search history.

(56) References Cited

U.S. PATENT DOCUMENTS 487,556 A * 12/1892 Dudley ..... A01C 11/00 221/185
967,487 A * 8/1910 Baker ..... A45F 5/02 224/272
1,935,612 A * 11/1933 Brady ..... B65D 29/02 383/117
1,999,753 A * 4/1935 Diemer ..... A47K 7/02 2/167
2,881,441 A * 4/1959 Bass ..... A41D 27/10 224/245
D440,041 S * 4/2001 Fermin ..... D3/226
6,209,769 B1 * 4/2001 Seals ..... A45F 3/02 224/675
6,571,997 B2 * 6/2003 Dedrick ..... B25H 3/00 224/183
6,651,854 B1 * 11/2003 LaCoste ..... A45F 5/021 224/236
6,695,189 B1 2/2004 Dolas
D507,972 S 8/2005 Watson
7,270,255 B2 * 9/2007 Badillo ..... A45F 5/02 224/583
D683,135 S 5/2013 Smith
D876,083 S 2/2020 Hamilton
2001/0027834 A1 * 10/2001 Southwick ..... A45F 5/00 150/108
2003/0218038 A1 * 11/2003 Chang ..... A45F 5/021 224/675
2012/0190413 A1 7/2012 Ojeda
(Continued)

FOREIGN PATENT DOCUMENTS

KR 100934120 B1 12/2009

*Primary Examiner* — Adam J Waggenspack
(74) *Attorney, Agent, or Firm* — John Rizvi; John Rizvi, P.A.—The Patent Professor®

(57) ABSTRACT

A phone and accessory holder for easily and conveniently carrying a cellphone and other items on a person's belt is disclosed. The phone and accessory holder includes a main body portion defining a main pocket having an open top for receipt of a cellphone and a belt strap attached to the main body portion and defining a loop for receipt of a user's belt. An interior accessory strap is positioned within the main pocket and includes a pocket for carrying a pen or stylus used in operating a touch screen of the cellphone. A front accessory panel is attached to the main body portion to form a card pocket therebetween for carrying one or more business cards.

16 Claims, 7 Drawing Sheets

(56) References Cited

U.S. PATENT DOCUMENTS

| | | | | |
|---|---|---|---|---|
| 2013/0221048 | A1* | 8/2013 | Revels | A45F 3/02 224/601 |
| 2017/0065065 | A1 | 3/2017 | Brewner | |
| 2022/0265032 | A1* | 8/2022 | Datcher | A61L 2/18 |

* cited by examiner

PHONE AND ACCESSORY HOLDER

CROSS-REFERENCE TO RELATED APPLICATION

This application claims the benefit of U.S. Provisional Patent Application No. 63/413,321, filed on Oct. 5, 2022, which is incorporated herein by reference it its entirety.

FIELD OF THE INVENTION

The present invention relates generally to phone cases, and more particularly, to a phone and accessory holder for carrying and easily accessing a cellphone and other accessories.

BACKGROUND OF THE INVENTION

Portable electronic devices such as pagers, small tablets, cellphones and the like are often carried in cases for protection of the devices as well as keeping them present for ease of use. Cellphones, for example, are often carried in cases which can be mounted on a belt either with a spring-loaded clip or belt-receiving loop.

Typical belt mounted cellphone cases have a hollow pocket to receive the cellphone and a cover or strap extending over the hollow pocket. This cover or strap is designed to hold the cellphone in the case. However, issues arise when it is necessary to quickly and easily pull the cellphone from the case. The cover or strap must first be undone to access the cellphone. This takes time, occasionally causing the user to miss the incoming call. Rapid access to the cellphone is also hindered by the cover or strap when the cellphone needs to be quickly accessed such as in the case of an emergency. Additionally, the cover or strap usually hangs over the hollow pocket requiring the user to move the cover or strap out of the way to place or replace the cellphone in the pocket. This can become a nuisance over time.

Cellphone users also often have need of a cellphone stylus or pen to easily access programs presented on a touch screen of the cellphone. Typical cellphone cases do not make accommodations for these styluses, which have to be carried separately. Other accessories or items that are typically required to be accessed in a short time, such as, but not limited to, business cards, are also not accommodated in the typical cellphone cases.

Accordingly, there is a need for a solution to at least one of the aforementioned problems. For instance, there is an established need for a cellphone carrying device that provides quick and easy access to the cellphone. There is a further established need for a cellphone carrying device that can accommodate a variety of accessories for ease of access.

SUMMARY OF THE INVENTION

The present invention is directed to a phone and accessory holder for easily and conveniently carrying a cellphone (also known as mobile phone or smartphone) and other items on a person's belt. The invention allows to safely carry the cellphone and other items with minimal interference with the person's body movements.

In one implementation of the invention, a phone and accessory holder may include a main body portion comprising a main pocket configured to receive and retain a cellphone. The main body portion may include a front panel and a rear panel defining the main pocket and arranged frontward and rearward of the main pocket, respectively. The main pocket may terminate in an open top end of the main body portion. The open top end may provide access to the main pocket. The cellphone may be inserted into the main pocket via the open top end of the main pocket. The phone and accessory holder may further include a belt strap affixed to the rear panel of the main body portion and forming a loop for receipt of a belt worn around the waist of a user. The loop may extend upward from the main body portion and may be arranged generally rearward of the open top end of the main body portion and in general vertical alignment with the rear panel of the main body portion. The phone and accessory holder may further include a first accessory pocket positioned within the main pocket of the main body portion. The first accessory pocket may be elongately formed and terminate in a top opening providing access to the first accessory pocket and enabling insertion and removal therethrough of a pen or stylus accessory into and from the first accessory pocket, respectively. The phone and accessory holder may further include a front accessory panel affixed to the front panel of the main body portion at an outer side of the front panel of the main body portion opposite the main pocket. The front accessory panel and the front panel of the main body portion may define a generally flat, second accessory pocket.

In a second aspect, the main body portion may further include a closed bottom end arranged below and facing the main pocket. The closed bottom end may be configured to retain the cellphone within the main pocket by gravity.

In another aspect, the front and rear panels may be connected to one another at left and right side edges of the main body portion to laterally retain the cellphone within the main pocket.

In another aspect, the front and rear panels may extend from one another along the left and right side edges.

In another aspect, the main body portion may be formed by a looped panel. Opposite ends of the looped panel may be secured to one another defining the rear panel of the main body.

In yet another aspect, the opposite ends of the looped panel may be arranged folded outward and away from one another on an outer side of the rear panel opposite the main pocket.

In another aspect, the closed bottom end of the main body portion may be defined by an attachment of a bottom end of the looped panel to itself.

In another aspect, the belt strap may be secured to the rear panel over an area of the rear panel at which the opposite ends of the looped panel are secured to one another.

In another aspect, the belt strap may be arranged in a folded configuration to form said loop for receipt of said belt.

In yet another aspect, the belt strap may be arranged over and attached to an inner side and an opposite, outer side of the rear panel, the inner side facing the main pocket and the outer side facing away from the main pocket.

In another aspect, the first accessory pocket may be formed by an interior accessory panel deformed into a loop which defines the first accessory pocket therewithin.

In another aspect, the first accessory pocket may be arranged at and along one of a left edge and a right edge of the main pocket of the main body portion. The first accessory pocket and main pocket may be configured to carry the pen or stylus accessory and the cellphone in side-by-side relationship with one another.

In another aspect, the first accessory pocket may extend generally vertically.

In another aspect, the top opening of the first accessory pocket may be arranged adjacent to the open top end of the main body portion.

In yet another aspect, the top opening of the first accessory pocket may be arranged within the main pocket of the main body portion.

In another aspect, the first accessory pocket may be secured to the main body portion.

In another aspect, the second accessory pocket may be accessible through a top opening formed between the front accessory panel and the front panel of the main body portion.

In another aspect, the front accessory panel may be secured to the front panel of the main body portion along a perimeter of the front accessory panel except along a top edge of the front accessory panel. The top opening formed between the front accessory panel and the front panel of the main body portion may be arranged along the top edge of the front accessory panel.

In another aspect, the second accessory pocket may be sized to receive one or more business cards.

In yet another aspect, the belt strap may be affixed to the main body portion by stitching.

In another aspect, the front accessory panel may be affixed to the main body portion by stitching.

In another aspect, the interior accessory strap may be affixed to the main body portion by stitching.

In another aspect, the interior accessory strap may be removable from within the main pocket of the main body portion.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed toward a belt mountable, phone and accessory holder for retaining a cellphone (also known as mobile phone or smartphone) in an easily accessible position and carrying auxiliary or accessory items such as a pen or stylus and/or one or more business cards or other type cards. For simplicity, the term 'cellphone' will be used hereinafter.

Figure 1:
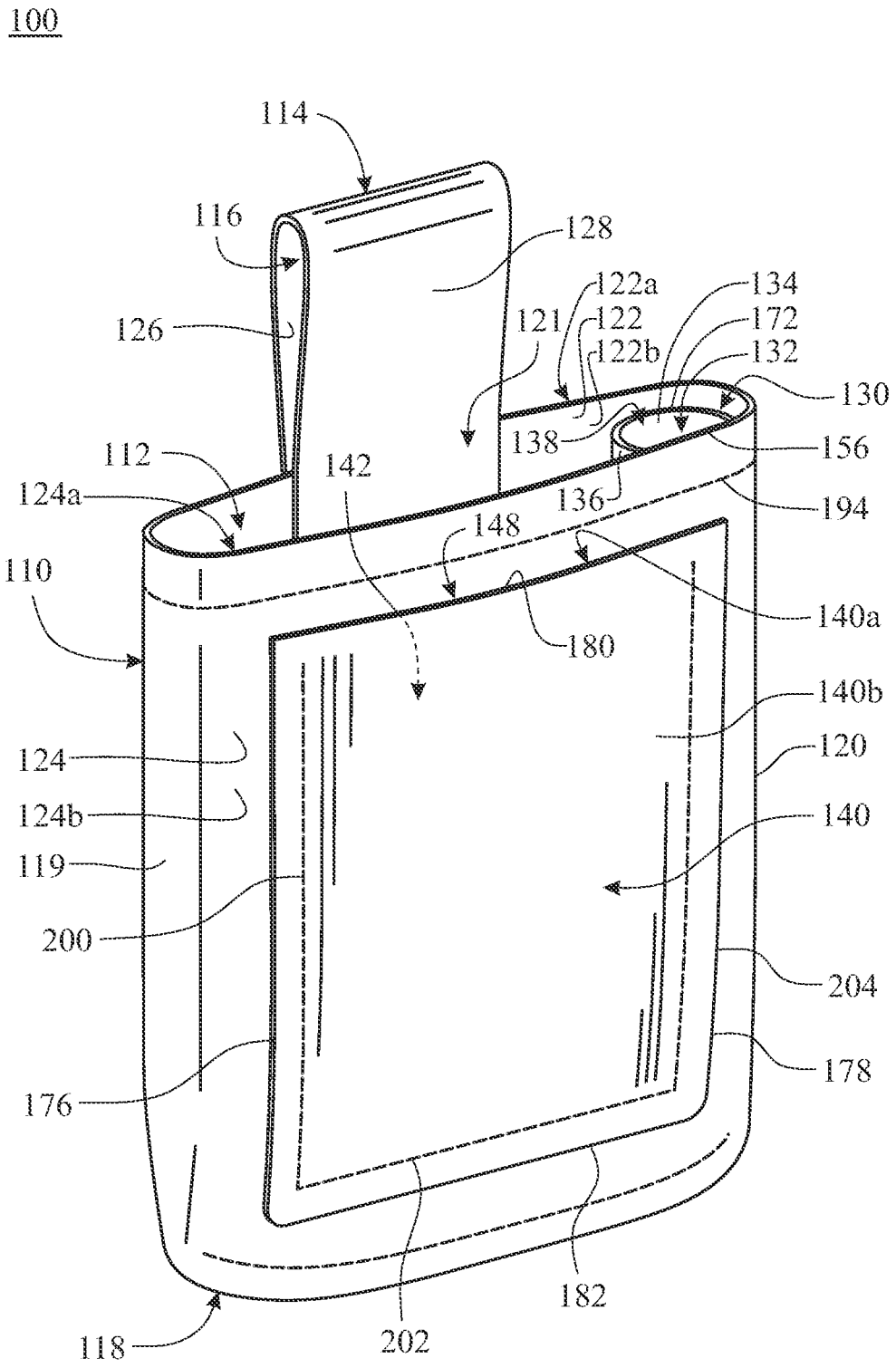
FIG. 1 presents a top front isometric view of a phone and accessory holder for carrying a cellphone and other accessories on a person's belt in accordance with an exemplary illustrative embodiment of the present invention.
Figure 2:
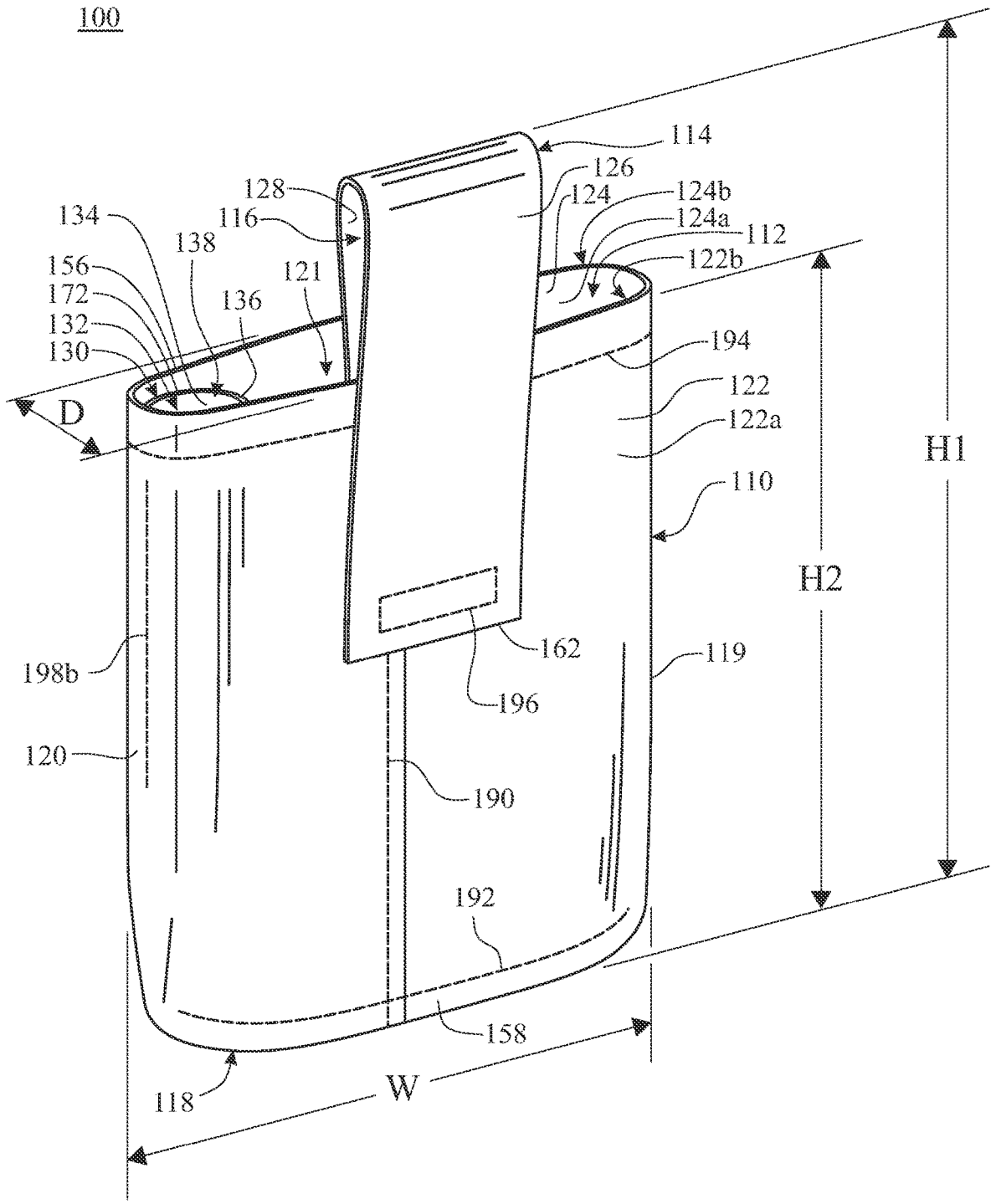
FIG. 2 presents a top rear isometric view of the phone and accessory holder for carrying a cellphone and other accessories on a person's belt illustrated in FIG. 1.

Referring initially to FIGS. 1 and 2, a belt mountable phone and accessory device or holder, hereinafter phone and accessory holder 100, is illustrated in accordance with an exemplary embodiment of the present invention. The phone and accessory holder 100 generally includes a main body portion 110 defining a main pocket 112 for retaining a phone 300 (FIGS. 6 and 7) or other similar device, hereinafter referred to generally as phone. The phone and accessory holder 100 further includes a belt strap 114 attached to the main body portion 110 and defining an opening or loop 116 for receipt of a belt 350 (FIG. 7) of a user. The main body portion 110 has a closed bottom 118 and an open top or top opening 121 for access to the main pocket 112. By providing the phone and accessory holder 100 with an open top or top opening 121, and in contrast to prior art devices, the disclosed phone and accessory holder 100 provides the user with easy and immediate access to a phone stored inside the main pocket 112. In accordance with the present invention, the phone can be removed without having to remove or reposition a flap or strap to access the phone retained within the main pocket 112 of the main body portion 110 of the phone and accessory holder 100, as discussed in more detail hereinbelow.

The main body portion 110 has a first or rear panel 122 and a second or front panel 124. The rear panel 122 has an outer side 122*a* and an opposite, inner side 122*b*. The front panel 124 has an inner side 124*a* and an opposite, outer side 124*b*. The inner side 122*b* of the rear panel 122 and the inner side 124*a* of the front panel 124 are arranged facing one another and define the main pocket 122. In some embodiments, the rear panel 122 and the front panel 124 are connected to one another at both a left side edge 119 and a right side edge 120 of the main body portion 110 to laterally retain the cellphone within the main pocket 112; for example, in the present embodiment, the rear panel 122 and front panel 124 extend from one another along the left side edge 119 and the right side edge 120 and are integrally formed with one another as will be described in further detail hereinafter.

In turn, the belt strap 114 has a first strap end portion 126 and an opposite, second strap end portion 128. As shown, the belt strap 114 is folded over to form and define the loop 116 with the belt strap 114. The first and second strap end portions 126 and 128 of the belt strap 114 are attached to the outer and inner sides 122*a* and 122*b*, respectively, of the rear panel 122 of the main body portion 110, and are generally coplanar with the outer and inner sides 122*a* and 122*b*, respectively.

With reference for instance to FIGS. 1 and 2, the phone and accessory holder 100 additionally includes an interior accessory panel or strap 130 positioned within the main pocket 112 of the main body portion 110 and forming and defining a first accessory pocket or pen pocket 132. The pen pocket 132 is provided to retain a pen for writing notes, a stylus or phone pen for operating touch screens provided on phones and the like. The interior accessory strap 130 may be permanently attached to the main body portion 110 or may be removable.

The pen pocket 132 may be elongately formed along a direction which is generally parallel to the direction along which the looped belt strap 114 extends from the main body portion 110; for example, the pen pocket 132 of the present embodiment is vertically elongated and the looped belt strap 114 extends vertically from the main body portion 110. The interior accessory strap 130 has a first or inner side 134 defining the pen pocket 132 and a second or outer side 136. The interior accessory strap 130 forms a top opening 138 to access the pen pocket 132. As shown, the top opening 138 is oriented vertically upward such that the stylus or pen must be inserted vertically downward into the pen pocket 132 through the top opening 138. When the interior accessory strap 130 is permanently attached to the main body portion 110, the second or outer side 136 of the interior accessory strap 130 is affixed to the inner side 122*a*, 124*a* of the rear or front panel 122, 124 of the main body portion 110 as discussed below. Furthermore, as shown, the top opening 138 is arranged at or near the top opening 121 of the main pocket 112; more preferably, the top opening 138 of the pen pocket 132 (and thus a top edge 172 of the interior accessory strap 130 which defines the top opening 138) may be arranged inside the main pocket 112 and adjacent to the top opening 121 of the main pocket 112 (i.e. adjacent to a top edge 156 of the main body portion 110 which defines the top opening 121).

With specific reference for the moment to FIG. 1, the phone and accessory holder 100 further includes a front accessory flap or panel 140 arranged adjacent to the main body portion 110 such that the front accessory panel 140 and main body portion 110 define a second accessory pocket or card pocket 142. The card pocket 142 is provided to retain papers and/or cards such as, but not limited to, business cards or note paper on the phone and accessory holder 100. The front accessory panel 140 has a rear or inner side 140*a* and an opposite, front or outer side 140*b*. The front accessory panel 140 is attached to the front panel 124 of the main body portion 110 with the inner side 140*a* of the front accessory panel 140 facing the outer side 124*b* of the front panel 124 to define the card pocket 142 therebetween. The card pocket 142, thus formed, has a top opening 148 for access to the card pocket 142. The outer side 140*b* of the front accessory panel 140 may be provided with various logos, embossments and the like.

The disclosed phone and accessory holder 100 is sized to easily and unobtrusively be worn on a user's belt. In preferred embodiments, the main body portion 110, the main pocket 112 or interior space of the main body portion 110, and the overall phone and accessory holder 100 may be generally flat, as shown, i.e. the depth of the main pocket 112 may be considerably less than the width and height of the main pocket 112. For example, with specific reference to FIG. 2, the phone and accessory holder 100 of the present embodiment has an overall height "H1" of approximately 5.5 inches, an overall width "W" of approximately 4.5 inches, and a depth "D" which is about one-fifth of the width "W". The main pocket 112 itself has a depth "H2" of approximately 121 mm or 4.72 inches.

Figure 3:
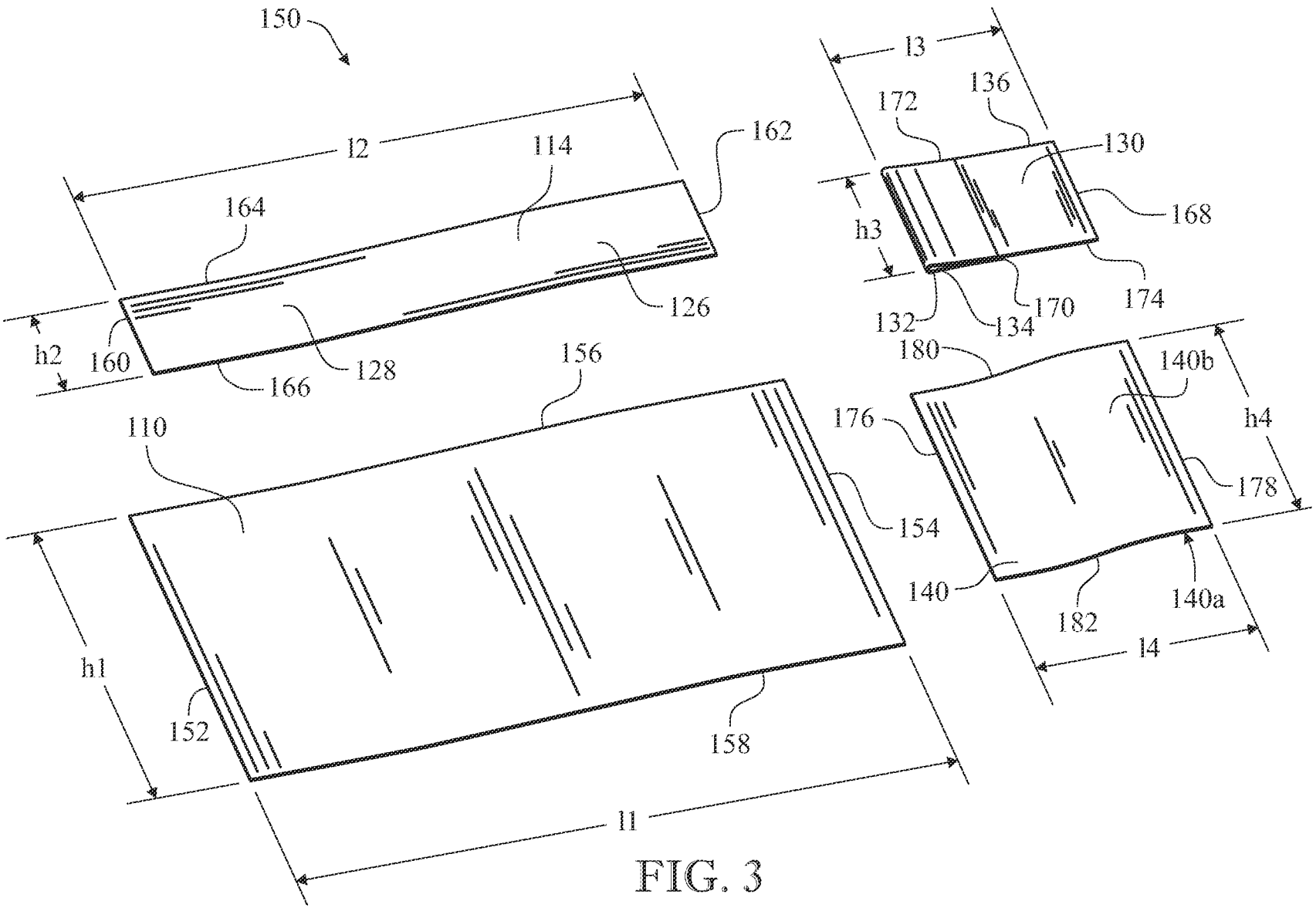
FIG. 3 presents an isometric view, with parts separated, of individual elements or pieces of the phone and accessory holder for carrying a cellphone and other accessories on a person's belt in a flat state as cut out from a source or sources of material.

Turning now to FIGS. 1-4, and initially with regard to FIG. 3, the construction of the phone and accessory holder 100 will now be described. As noted hereinabove, the phone and accessory holder 100 includes the main body portion 110, the belt strap 114, the interior accessory strap 130 and the front accessory panel 140. For the purposes of discussion, in the unassembled state, the main body portion 110, the belt strap 114, the interior accessory strap 130 and the front accessory panel 140 form the components 150 of the phone and accessory holder 100.

The components 150 of the phone and accessory holder 100 may be formed from a variety of materials such as, but not limited to, synthetic materials and natural materials. The synthetic materials may include various plastics or polymers while the natural materials may include various plant fibers such as, but not limited to, cotton or canvas, wool, hemp, or other cloth materials, etc. The natural materials may further include various animal materials in the form of processed leathers or skins. The leathers may be sourced from various animals such as for example cows, horses, bison or buffalo, deer, lamb, and the like. The skins may be sourced from reptile skins such as, but not limited to, alligator or crocodile, snake skin, lizard skin, etc. or bird skins such as for example ostrich or emu and the like. The components 150 may be formed of one material or any combination of materials.

The various components 150 of the phone and accessory holder 100 may be cut out of such materials and formed in a variety of manners such as, but not limited to, by stamping, hand or machine cutting, laser cutting and the like. In a preferred embodiment, the method of forming the various components 150 includes hand cutting the desired materials to size.

As shown, the main body portion 110 is generally rectangular. The main body portion 110 has a first end 152, a second end 154, top edge 156, and a bottom edge 158. The main body portion 110, in the unassembled state, has a length "11" of approximately 10 to 10⅛ inches and a height "h1" of approximately 5¾ inches. While not specifically shown, the main body portion 110 has a thickness depending on the material chosen and the methods used in processing it. In a preferred embodiment, the main body portion 110 is formed from a relatively stiff leather.

The belt strap 114 is also generally rectangular having the first strap end portion 126 and the second strap end portion 128. The belt strap 114 has a first end 160, a second end 162, a first side edge 164 and a second side edge 166. The belt strap 114, in the unassembled state, has a length "12" of approximately 8 to 8½ inches and a height "h2" of approximately 1½ to 1⅝ inches. As above, the thickness of the belt strap 114 depends on the material chosen. In the preferred embodiment, the belt strap 114 is also formed from a relatively stiff leather.

The interior accessory strap 130 in the unassembled state is generally rectangular, having the first or inner side 134 (FIG. 4) and the second or outer side 136. The interior accessory strap 130 has a first end 168, a second end 170, a top edge 172 and a bottom edge 174. While the interior accessory strap 130 is illustrated in a folded over on itself condition in FIG. 3, in the pre-folded condition the interior accessory strap 130 has a general overall length of approximately 7 inches. In the folded over condition, the interior accessory strap 130 has a length "13" of approximately 3½ to 4 inches and a height "h3" of approximately 2 to 2¼ inches. The thickness of the interior accessory strap 130 also depends on the material chosen which, in the preferred embodiment, is a relatively stiff leather. The interior accessory strap 130 can preferably be 2"×4". A 12"×4" piece of material is sewn together and then cut into 2" sections. The interior accessory strap 130 is preferably glued into the main body portion 110.

The front accessory panel 140 is generally rectangular approaching square shaped having the inner side 140*a* and the outer side 140*b*. The front accessory panel 140 has a left edge or end 176, a right edge or end 178, a top edge or end 180 and a bottom edge or end 182. The front accessory panel 140 has a length "14" of approximately 3½ to 3⅜" inches and a height "h4" of approximately 4 inches. The thickness of the front accessory panel 140 depends upon the material chosen. In the preferred embodiment, the front accessory panel 140 is formed from a reptile skin such as, but not limited to, alligator skin.

Figure 4:
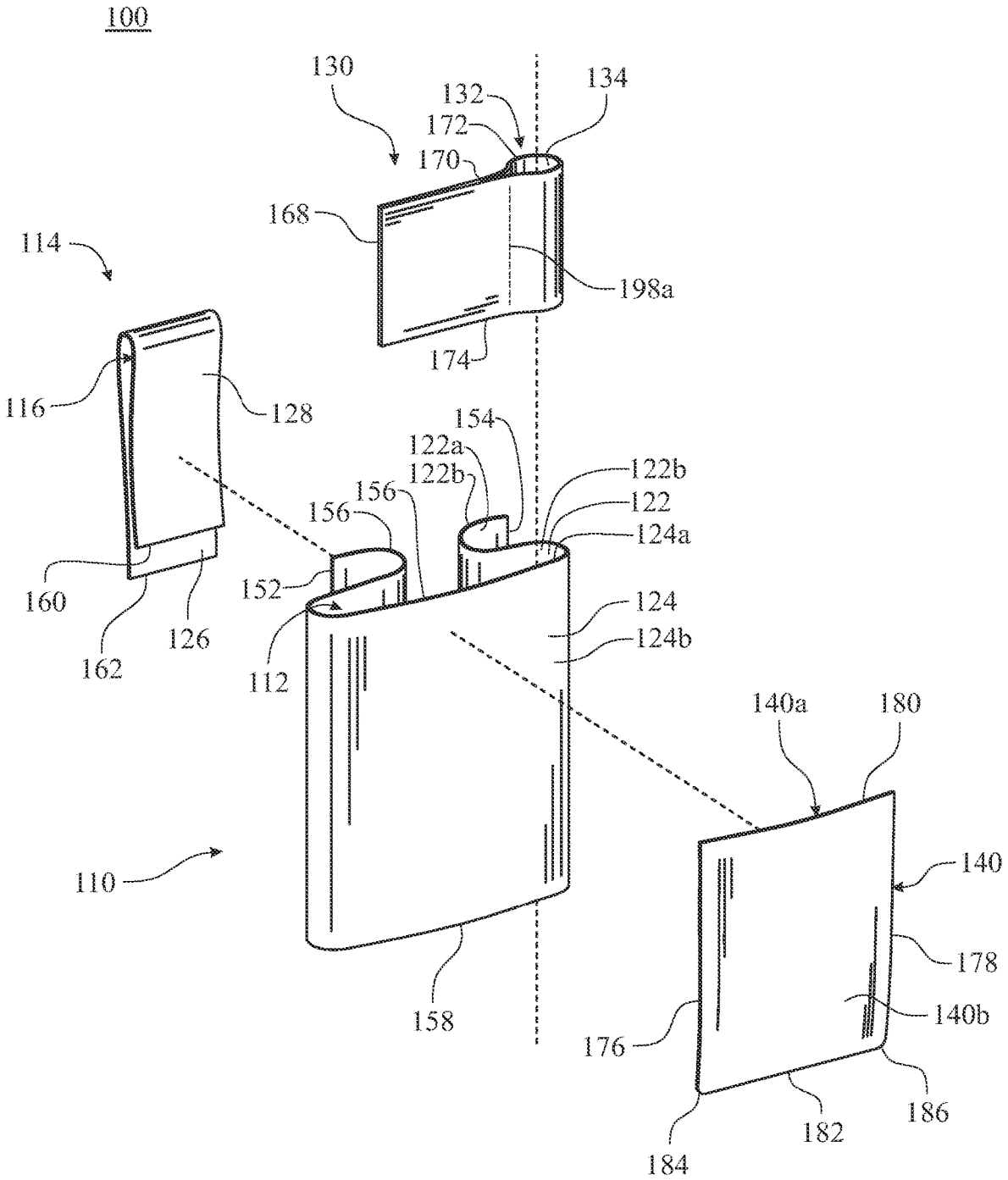
FIG. 4 presents a top front isometric view, with parts separated, of the individual elements or pieces of the phone and accessory holder for carrying a cellphone and other accessories on a person's belt in a folded state prior to assembly.

Turning now to FIGS. 1, 2 and 4, the method of assembling the components 150 of the phone and accessory holder 100, including the main body portion 110, the belt strap 114, the interior accessory strap 130 and the front accessory panel 140, into the fully assembled phone and accessory holder 100 will now be described. The various components 150 may be assembled together in a variety of different sequences and with various connections or connecting elements or methods such as, but not limited to, glues or gluing, stitching with natural or synthetic materials, and the like.

Referring to FIGS. 2 and 4, and initially with respect to FIG. 4, the main body portion 110 is folded or looped to create the main pocket 112 as shown and define the rear and front panels 122 and 124, respectively. At the rear panel 122, the first and second ends 152 and 154 of the main body portion 110 are then folded back, away from one another as shown, such that the inner sides 122*b* of the rear panel 122 at the first and second ends 152 and 154 face outward. The now outward turned first and second ends 152 and 154 are brought together in overlapping relation and joined together to close the main pocket 112 at the rear or inner side thereof, i.e. at the rear panel 122 as shown in FIG. 2. With continued reference to FIG. 2, the first and second ends 152 and 154 can be joined in a variety of manners such as, but not limited to, gluing, fusing, etc.; in a preferred embodiment, the first and second ends 152 and 154 of the main body portion 110 are joined with a line of stitching 190.

As a consequence of attaching the first and second ends 152 and 154 to one another, the bottom edge 158 of the main body portion 110 is formed into a loop. Thereafter, the bottom edge 158, having been formed into a loop, is secured together to form the closed bottom 118 of the main pocket 112 (FIG. 2). As above, this can be accomplished in a variety of manners and, in the preferred embodiment, is accomplished with a line of stitching 192 (FIG. 2). Since the looped or wrapped around bottom edge 158 is secured to itself, the bottom edge 158 converges together or closes to form a tapered closed bottom 118. By forming the main body portion 110 of the phone and accessory holder 100 with a tapered closed bottom 118, the phone and accessory holder 100 is easily inserted in a pocket of a user by inserting the tapered closed bottom 118 first, should the user wish to carry the phone and accessory holder 100 in a clothes pocket.

Thus, the main pocket 112 is fully formed with or defined by the main body portion 110. As shown for instance in FIGS. 1 and 2, a third line of stitching 194 is provided around the main body portion 110 adjacent to the top edge 156 of the main body portion 110 to stiffen the main body portion 110 at the top edge 156 and maintain the shape of the top opening 121. The remaining components 150 of the phone and accessory holder 100 can now be attached to the main body portion 100.

The belt strap 114 is folded over such that opposite end portions of the belt strap 114, referred to herein as the first strap end portion 126 and the second strap end portion 128, are arranged facing one another as shown in FIGS. 1 and 2 and thereby form the opening or loop 116 of the belt strap 114. The loop 116 is arranged with the first strap end portion 126 facing inward and the second strap end portion 128 facing outward. The belt strap 114 is then positioned over the top edge 156 of the main body portion 110 such that the first and second ends 160 and 162 are positioned at and along the inner side 122*b* and the outer side 122*a* of the rear panel 122 of the main body portion 110. I.e., the belt strap 114 is folded or looped in half and is "saddled" over the rear panel 122, with the opening or loop 116 arranged upward of the top edge 156 of the main body portion 110.

Thereafter, the belt strap 114 and in particular the first and second strap end portions 126 and 128 of the belt strap 114 can be secured to the main body portion 110. Specifically, the first strap end portion 126 of the belt strap 114 adjacent to the second end 162 of the belt strap 114 is secured to the outer side 122*a* of the rear panel 122 of the main body portion 110, and the strap end portion 128 of the belt strap 114 adjacent to the first end 160 is secured to the inner side 122*b* of the rear panel 122 of the main body portion 110. In the preferred embodiment, the securing of the first and second strap end portions 126 and 128 to the main body portion 110 may be achieved with a stitching 196, which may be arranged 2 inches into the main body portion 110 as measured from the top edge 156.

The interior accessory strap 130 forming the pen pocket 132 may be formed before the above or after. The pen pocket 132 is formed by folding the interior accessory strap 130 around on itself causing the first or inner side 134 at the second end 170 of the interior accessory strap 130 to touch or mate with the inner side 134 of an intermediate area of the interior accessory strap 130 as shown in FIGS. 3 and 4. Thereafter, the pen pocket 132 is formed with a line of stitching 198*a* immediately adjacent to the pen pocket 132.

In some embodiments, such as the present embodiment, a flat end portion 135 may extend from the pen pocket 132, i.e. from the loop formed by the interior accessory strap 130. It should be noted that the interior accessory strap 130, forming the pen pocket 132, may be permanently affixed to the main body portion 110 on an inner wall thereof (e.g., the inner side 122*b* of the rear panel 122) with a second line of stitching 198*b* (FIG. 2) or may be removable to increase the available space in the main pocket 112. The interior accessory strap 130 may be temporarily attached to the main body portion 110 with a hook and loop fastener or other easily removable attachment system. Alternatively or additionally, the flat end portion 135 may be permanently or non-permanently attached to the main body portion 110.

Finally, and with reference to FIGS. 1 and 4, the front accessory panel 140 is attached to the main body portion 110 to form the second accessory or card pocket 142 (FIG. 1). The front accessory panel 140 is positioned over the main body portion 110 on an opposite side from the belt strap 114. More specifically, as shown, the looped, belt strap 114 is carried by and extends upward of the rear panel 122 while the front accessory panel 140 is carried by and arranged frontward of the front panel 124.

The front accessory panel 140 is arranged such that the inner side 140*a* of the front accessory panel 140 faces the outer side 124*b* of the front panel 124 of the main body portion 110. The front accessory panel 140 is secured to the main body portion 110 to form the card pocket 142. The front accessory panel 140 of the present embodiment is sewn such that the top edge or end 180 of the front accessory panel 140 is ⅞ inches below the top edge 156 of the main body portion 110. Specifically, a first line of stitching 200 extends along the left edge or end 176 of the front accessory panel 140, a second line of stitching 202 extends along the bottom edge or end 182 and a third line of stitching 204 extends along the right edge or end 178, thereby securing the left edge or end 176, bottom edge or end 182 and right edge or end 178 of the front accessory panel 140 to the front panel 124 of the main body portion 110. The first, second and third lines of stitching 200, 202 and 204, respectively, extend through both the front accessory panel 140 and the front panel 124 of the main body portion 110 to secure the front accessory panel 140 to the main body portion 110. The top edge or end 180 of the front accessory panel 140 is not stitched to the main body portion 110 and forms the top opening 148 of the card pocket 142 (FIG. 1). The front accessory panel 140 has slightly rounded first and second lower corners 184 and 186 (FIG. 4).

Thus, in this manner, the phone and accessory holder 100 is fully formed from the components 150. As noted hereinabove, various embossing, indicia or other markings or designs may be provided on the components 150 of the phone and accessory holder and, in particular, on the front accessory panel 140.

Figure 5:
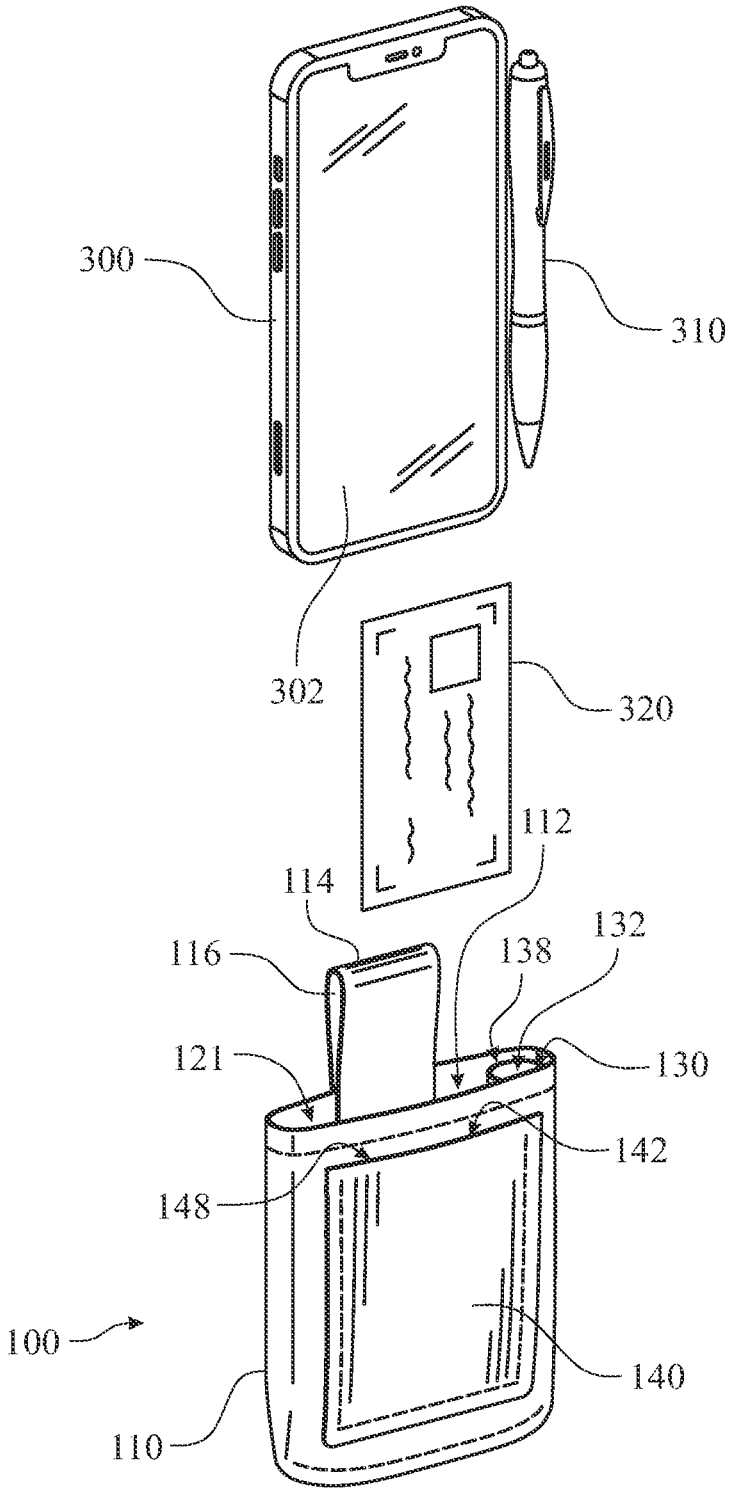
FIG. 5 presents a top front isometric view of the assembled phone and accessory holder for carrying a cellphone and other accessories on a person's belt ready to receive a cellphone, accessory pen or stylus and business card.
Figure 6:
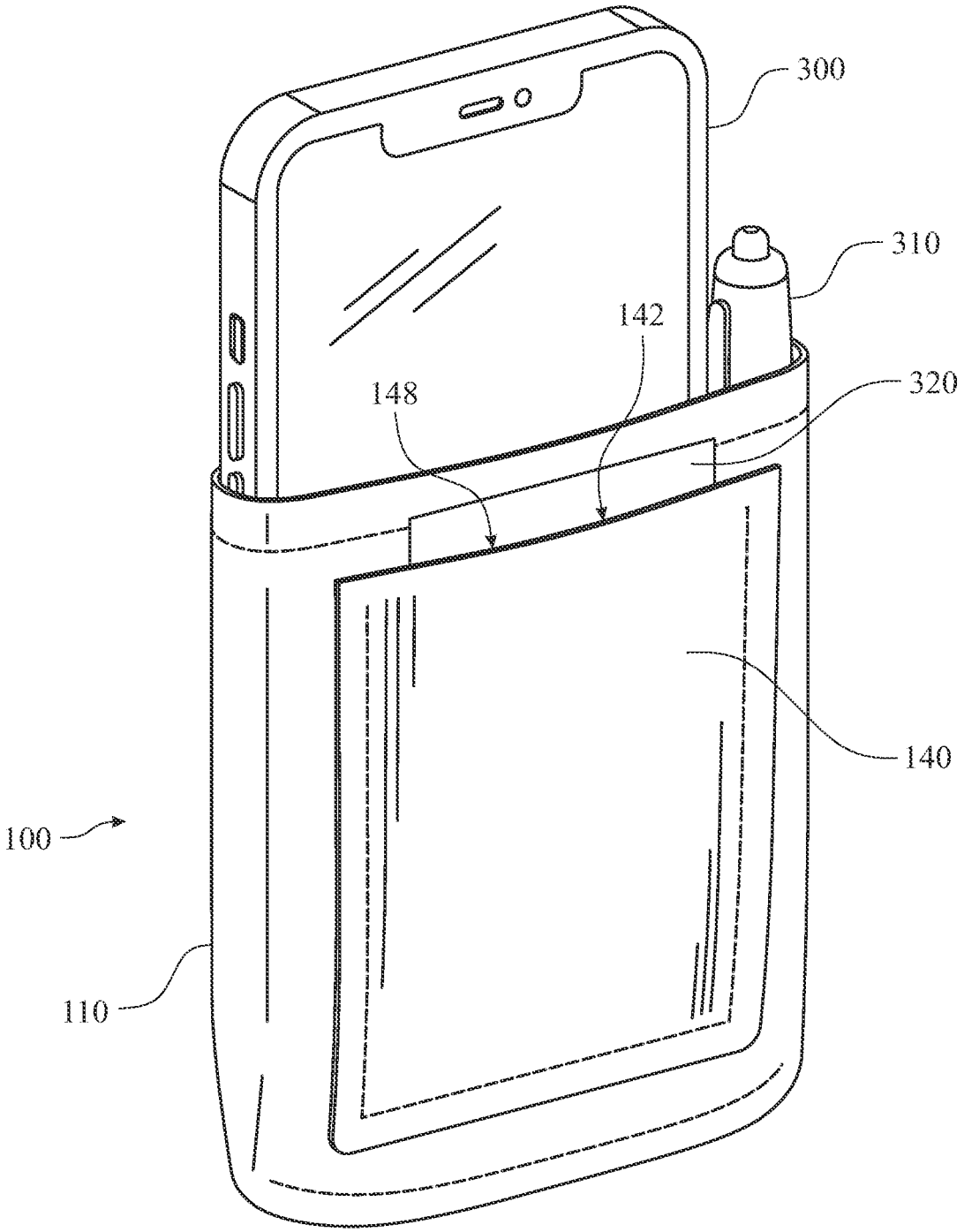
FIG. 6 presents a top front isometric view, similar to FIG. 5, with the cellphone, accessory pen or stylus and business card inserted into the disclosed phone and accessory holder for carrying a cellphone and other accessories on a person's belt of FIG. 1.
Figure 7:
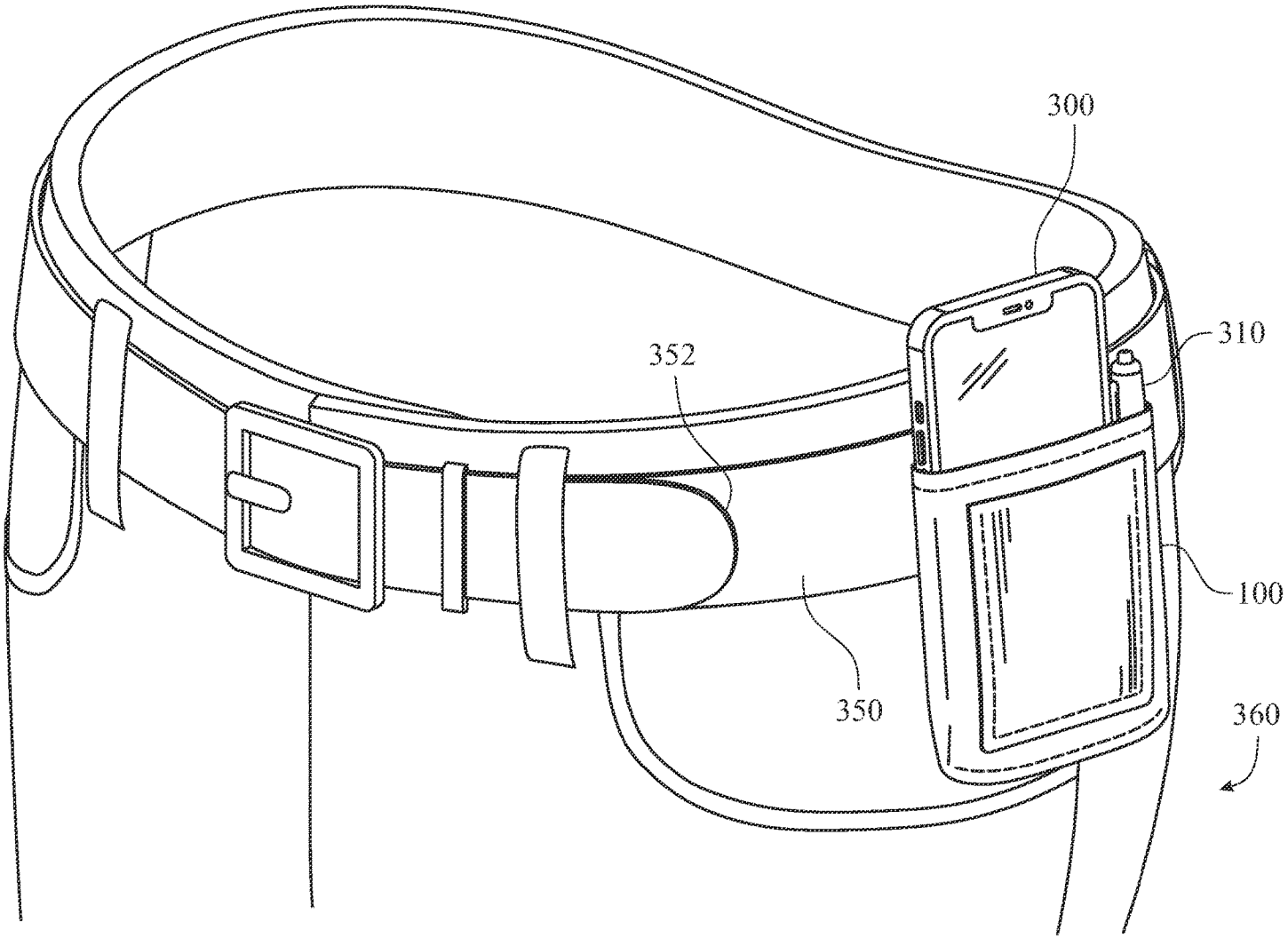
FIG. 7 presents a top front isometric view of the assembled phone and accessory holder for carrying a cellphone and other accessories on a person's belt attached to a belt.

Turning to FIGS. 5-7, and initially with regard to FIGS. 5 and 6, in use, the disclosed belt phone and accessory holder device or phone and accessory holder 100 is provided to easily and conveniently carry a portable electronic device such as, but not limited to, a cellphone 300 and a writing implement such as a stylus, pencil or pen 310. The pen 310 may be of the type used to activate a touch screen 302 of the cellphone 300 or may be used for writing on various media.

The cellphone 300 is inserted into the phone and accessory holder 100 by moving the cellphone 300 though the top opening 121 in the main body portion 110 and into the main pocket 112. Having the top opening 121 arranged at the top, and more particularly, having the top opening 121 oriented upwardly (i.e. formed along a generally horizontal plane) facilitates insertion of the cellphone 300 into the main pocket 112, as said insertion is assisted by gravity, and further allows gravity to retain the cellphone 300 within the main pocket 112. Once the cellphone 300 is received within the main pocket 112 as shown in FIGS. 6 and 7, since the phone and accessory holder 100 does not include any cover, strap or other device extending over the top opening 121 of the main pocket, the user can easily and quickly insert and remove the cellphone 300 from the phone and accessory holder 100. Such insertion and removal is further facilitated by the fact that the opening or loop 116, i.e. the looped belt strap 114, is arranged rearward of the front panel 124 of the main body portion 110. Such insertion and removal is further facilitated, in preferred embodiments such as the present embodiment, by having the looped belt strap 114 arranged generally coplanar with the rear panel 112 of the main body portion 110 and positioned generally rearward of the main pocket 112; for example, the looped belt strap 114 may be arranged rearward of the main pocket 112, or at a rear end of the main pocket 112, as shown in FIGS. 1 and 2 and understood in FIGS. 6 and 7, which show the cellphone 300 arranged frontward of and covering the looped belt strap 114.

With continued reference to FIGS. 6 and 7, the pen 310 is easily inserted into the pen pocket 132 of the interior accessory strap 130 by inserting the pen 310 through the top opening 138 of the interior accessory strap 130. Insertion is facilitated by having the top edge 172 of the interior accessory strap 130, and thus the top opening 138 of the interior accessory strap 130, arranged at or near the top edge 156 of the main body portion 110 as shown in FIGS. 1 and 2. Both the cellphone 300 and the pen 310 may be held in the phone and accessory holder 100 in friction fit fashion. In preferred embodiments, the pen pocket 132 is arranged at and along one of a left edge and a right edge of the main pocket 112 of the main body portion 110 (said left and right edges adjacent to the left side edge 119 and the right side edge 120 of the main body portion 110, respectively), and the pen pocket 132 and main pocket 112 care configured to carry the pen 310 and the cellphone 300 in side-by-side relationship with one another. This minimizes outward bulkiness of the overall assembly with respect to the wearer's body and thereby minimizes the interference of the assembly with the user's body movements while wearing the phone and accessory holder 100. For instance, in the non-limiting example shown in the drawing, the pen pocket 132 is arranged at and along the right edge of the main pocket 112 adjacent to the right side edge 120 of the main body portion 110, and the pen 310 is carried in side-by-side relationship with the pen 300 on a right side of the pen 300 (FIGS. 6 and 7).

The phone and accessory holder 100 is further provided to carry items in the second accessory or card pocket 142 formed between the front accessory panel 140 and the main body portion 110. As shown a card or cards, for example one or more business cards 320 can be carried in the card pocket 142. The cards 320 are inserted through the top opening 148 of the card pocket 142 and into the card pocket 142. By having the card pocket 142 formed on one of the panels of the main body 110, particularly the front panel 124, rigid or semirigid card(s) stored in the card pocket 142 contribute to maintaining the front panel 124 relatively undeformed and snugly fitted against the cellphone 300, further contributing to safely store the cellphone 300 inside the main pocket 112.

Referring now to FIG. 7, the disclosed phone and accessory holder 100 is designed to be carried on a belt, such as, but not limited to belt 350 mounted around a user's pants 360. The user (not shown) inserts an end 352 through the loop 116 of the belt strap 114 (FIG. 5) of the phone and accessory bolder 100 to secure the phone and accessory holder 100 to the users belt 350. As discussed, the cellphone 300 inside the main pocket 112 is arranged frontward of the looped belt strap 114 and readily available. The pen pocket 132 and pen 310 are arranged on a side of the cellphone 300 and thus generally do not increase the depth "D" of the main body portion 110 (FIG. 2) and thus the depth of the main pocket 112, allowing the cellphone 300 to remain snugly received within the main pocket 112 regardless of whether or not a pen 310 is inserted in the pen pocket 132. Thus, in this manner, the phone and accessory holder 100 provides a novel device for easily and safely carrying and removing a cellphone 300, a pen 310 and one or more business cards 320.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A phone and accessory holder comprising:

a main body portion comprising a main pocket configured to receive and retain a cellphone, the main body portion further comprising a front panel and a rear panel defining the main pocket and arranged frontward and rearward of the main pocket, respectively, wherein the main pocket terminates in an open top end of the main body portion, the open top end providing access to the main pocket and enabling insertion of the cellphone therethrough into the main pocket, wherein the front and rear panels are connected to one another at left and right side edges of the main body portion to laterally retain the cellphone within the main pocket, and further wherein the front and rear panels extend from one another along said left and right side edges;

a belt strap affixed to the rear panel of the main body portion and forming a loop for receipt of a belt worn around a waist of a user, wherein the loop extends upward from the main body portion and is arranged generally rearward of the open top end of the main body portion and in general vertical alignment with the rear panel of the main body portion;

a first accessory pocket positioned within the main pocket of the main body portion, the first accessory pocket elongately formed and terminating in a top opening providing access to the first accessory pocket and enabling insertion and removal therethrough of a pen or stylus accessory into and from the first accessory pocket, respectively; and a front accessory panel affixed to the front panel of the main body portion at an outer side of the front panel of the main body portion opposite the main pocket, the front accessory panel and the front panel of the main body portion defining a generally flat, second accessory pocket; wherein the main body portion is formed by a looped panel, wherein opposite ends of the looped panel are secured to one another defining the rear panel of the main body portion, and wherein said opposite ends of the looped panel are arranged folded outward and away from one another on an outer side of the rear panel opposite the main pocket.

2. The phone and accessory holder of claim 1, wherein the main body portion further comprises a closed bottom end, the closed bottom end arranged below and facing the main pocket and configured to retain the cellphone within the main pocket by gravity.

3. The phone and accessory holder of claim 2, wherein the closed bottom end is defined by an attachment of a bottom end of the looped panel to itself.

4. The phone and accessory holder of claim 1, wherein the belt strap is secured to the rear panel over an area of the rear panel at which the opposite ends of the looped panel are secured to one another.

5. The phone and accessory holder of claim 1, wherein the belt strap is arranged in a folded configuration to form said loop for receipt of said belt.

6. The phone and accessory holder of claim 1, wherein the belt strap is arranged over and attached to an inner side and an opposite, outer side of the rear panel, the inner side facing the main pocket and the outer side facing away from the main pocket.

7. The phone and accessory holder of claim 1, wherein the first accessory pocket is formed by an interior accessory panel deformed into a loop, said loop formed by the interior accessory panel defining the first accessory pocket therewithin.

8. The phone and accessory holder of claim 1, wherein the first accessory pocket is arranged at and along one of a left edge and a right edge of the main pocket of the main body portion, the first accessory pocket and main pocket configured to carry the pen or stylus accessory and the cellphone in side-by-side relationship with one another.

9. The phone and accessory holder of claim 1, wherein the first accessory pocket extends generally vertically.

10. The phone and accessory holder of claim 1, wherein the top opening of the first accessory pocket is arranged adjacent to the open top end of the main body portion.

11. The phone and accessory holder of claim 1, wherein the top opening of the first accessory pocket is arranged within the main pocket of the main body portion.

12. The phone and accessory holder of claim 1, wherein the first accessory pocket is secured to the main body portion.

13. The phone and accessory holder of claim 1, wherein the second accessory pocket is accessible through a top opening formed between the front accessory panel and the front panel of the main body portion.

14. The phone and accessory holder of claim 13, wherein the front accessory panel is secured to the front panel of the main body portion along a perimeter of the front accessory panel except along a top edge of the front accessory panel, wherein the top opening formed between the front accessory panel and the front panel of the main body portion is arranged along the top edge of the front accessory panel.

15. A phone and accessory holder comprising:

a main body portion comprising a main pocket configured to receive and retain a cellphone, the main body portion further comprising a front panel and a rear panel defining the main pocket and arranged frontward and rearward of the main pocket, respectively, wherein the main pocket terminates in an open top end of the main body portion, the open top end providing access to the main pocket and enabling insertion of the cellphone therethrough into the main pocket, wherein the main body portion further comprises a closed bottom end, the closed bottom end arranged below and facing the main pocket and configured to retain the cellphone within the main pocket by gravity, and further wherein the front and rear panels are connected to one another at left and right side edges of the main body portion to laterally retain the cellphone within the main pocket, and further wherein the front and rear panels extend from one another along said left and right side edges;

a belt strap affixed to the rear panel of the main body portion and forming a loop for receipt of a belt worn around a waist of a user, wherein the loop extends upward from the main body portion and is arranged generally rearward of the open top end of the main body portion and in general vertical alignment with the rear panel of the main body portion;

a first accessory pocket positioned within the main pocket of the main body portion, the first accessory pocket elongately formed and terminating in a top opening providing access to the first accessory pocket and enabling insertion and removal therethrough of a pen or stylus accessory into and from the first accessory pocket, respectively, wherein the first accessory pocket extends generally vertically and is arranged at and along one of a left edge and a right edge of the main pocket of the main body portion, the first accessory pocket and main pocket configured to carry the pen or stylus accessory and the cellphone in side-by-side relationship with one another; and a front accessory panel affixed to the front panel of the main body portion at an outer side of the front panel of the main body portion opposite the main pocket, the front accessory panel and the front panel of the main body portion defining a generally flat, second accessory pocket; wherein the main body portion is formed by a looped panel, wherein opposite ends of the looped panel are secured to one another defining the rear panel of the main body, and wherein said opposite ends of the looped panel are arranged folded outward and away from one another on an outer side of the rear panel opposite the main pocket.

16. A phone and accessory holder comprising:

a main body portion comprising a main pocket configured to receive and retain a cellphone, the main body portion further comprising a front panel and a rear panel defining the main pocket and arranged frontward and rearward of the main pocket, respectively, wherein the main pocket terminates in an open top end of the main body portion, the open top end providing access to the main pocket and enabling insertion of the cellphone therethrough into the main pocket, wherein the main body portion further comprises a closed bottom end, the closed bottom end arranged below and facing the main pocket and configured to retain the cellphone within the main pocket by gravity, and further wherein the front and rear panels are connected to one another at left and right side edges of the main body portion to laterally retain the cellphone within the main pocket, wherein the front and rear panels extend from one another along said left and right side edges;

a belt strap affixed to the rear panel of the main body portion and forming a loop for receipt of a belt worn around a waist of a user, wherein the loop extends upward from the main body portion and is arranged generally rearward of the open top end of the main body portion and in general vertical alignment with the rear panel of the main body portion;

a first accessory pocket positioned within the main pocket of the main body portion and secured to the main body portion, the first accessory pocket elongately formed and terminating in a top opening providing access to the first accessory pocket and enabling insertion and removal therethrough of a pen or stylus accessory into and from the first accessory pocket, respectively, the top opening of the first accessory pocket arranged within the main pocket of the main body portion and adjacent to the open top end of the main body portion, wherein the first accessory pocket extends generally vertically and is arranged at and along one of a left edge and a right edge of the main pocket of the main body portion, the first accessory pocket and main pocket configured to carry the pen or stylus accessory and the cellphone in side-by-side relationship with one another; and a front accessory panel affixed to the front panel of the main body portion at an outer side of the front panel of the main body portion opposite the main pocket, the front accessory panel and the front panel of the main body portion defining a generally flat, second accessory pocket; wherein the main body portion is formed by a looped panel, wherein opposite ends of the looped panel are secured to one another defining the rear panel of the main body, and wherein said opposite ends of the looped panel are arranged folded outward and away from one another on an outer side of the rear panel opposite the main pocket.

* * * * *